US009772075B2

(12) United States Patent
Van Delden

(10) Patent No.: US 9,772,075 B2
(45) Date of Patent: Sep. 26, 2017

(54) METHOD OF MANUFACTURING A LIGHTING DEVICE

(71) Applicant: KONINKLIJKE PHILIPS N.V., Eindhoven (NL)

(72) Inventor: Martinus Hermanus Wilhelmus Maria Van Delden, Venlo (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 175 days.

(21) Appl. No.: 14/877,066

(22) Filed: Oct. 7, 2015

(65) Prior Publication Data

US 2016/0102822 A1 Apr. 14, 2016

(30) Foreign Application Priority Data

Oct. 9, 2014 (EP) ..... 14188237

(51) Int. Cl.

| | |
|---|---|
| ***F21K 99/00*** | (2016.01) |
| ***F21K 9/90*** | (2016.01) |
| ***F21V 3/04*** | (2006.01) |
| ***H01J 9/34*** | (2006.01) |
| ***F21K 9/27*** | (2016.01) |
| *F21Y 103/10* | (2016.01) |
| *F21Y 115/10* | (2016.01) |

(52) U.S. Cl.

CPC ..... *F21K 9/90* (2013.01); *F21K 9/27* (2016.08); *F21V 3/0418* (2013.01); *H01J 9/34* (2013.01); *F21Y 2103/10* (2016.08); *F21Y 2115/10* (2016.08)

(58) Field of Classification Search

CPC ..... F21K 9/90; F21K 9/27; H01J 9/34; F21V 3/0418; F21Y 2103/10

See application file for complete search history.

(56) References Cited

U.S. PATENT DOCUMENTS 5,412,289 A 5/1995 Thomas et al.

FOREIGN PATENT DOCUMENTS

| | | | | |
|---|---|---|---|---|
| EP | 2472169 | A2 | 7/2012 | |
| JP | WO 2013175689 | A1 * | 11/2013 | ..... F21K 9/90 |
| WO | 2013137816 | A1 | 9/2013 | |
| WO | 2013175689 | A1 | 11/2013 | |
| WO | 2014135357 | A1 | 9/2014 | |

* cited by examiner

*Primary Examiner* — David V Bruce

(57) ABSTRACT

Various embodiments are directed to a method of manufacturing a lighting device. In one example, the method comprises providing a glass envelope having one or more openings, inserting a first device component through one of the one or more openings, and providing at least one of the one or more openings with a glass cap by way of melt-joining. Prior to melt-joining the first device component is moved to a position within the glass envelope away from the at least one of the one or more openings. The first device component is repositioned and/or expanded within the glass envelope after melt-joining.

13 Claims, 8 Drawing Sheets

METHOD OF MANUFACTURING A LIGHTING DEVICE

FIELD OF THE INVENTION

The invention relates to a method of manufacturing a lighting device, a lighting device manufactured by such a method and to a luminaire comprising at least one such a lighting device.

BACKGROUND OF THE INVENTION

When it comes to traditional and solid-state lighting devices, enclosures made of glass are still the most economical ones. However, because of some unsolved challenges in glass and in particular in glass based light tubes, the use of costly plastic tubes and end-caps has become rather wide spread. A first problem with plastic tubes is that they are more expensive than glass. A second problem with plastic tubes is that an asymmetric temperature distribution across the tube height and/or length will and does cause warp, deforms the tube permanently. To avoid the problem of warping some plastic tubes do come with build-in material pre-stress (in the opposing direction) causing the tubes to straighten on operation. Furthermore, the look and feel of plastic is inferior to that of glass.

The key problem with the highly appreciated glass is that it can only be worked at high temperature, say above 1200° C. Hence, when delicate electronics components come too close to the hot glass, severe and irreversible degradation is eminent. With the high temperatures required during the joining of the glass pieces being the key issue, there is a need to allow for the pre-sealing insertion of fragile electronics components into the glass body and/or to shield them from the high temperatures during the glass joining and in a cost effective manner.

SUMMARY OF THE INVENTION

It is an object of the invention to provide a method of manufacturing a lighting device which allows for the insertion of (vulnerable) electronic components into a glass envelope prior to closing of the glass envelope without compromising on the quality and life-time of the electronic components.

According to an aspect, there is provided a method of manufacturing a lighting device, the method comprising:

- providing a glass envelope having one or more openings;
- inserting a first device component into the glass envelope through one of the one or more openings;
- providing at least one of the one or more openings with a glass cap by way of melt-joining, wherein prior to melt-joining the first device component is moved to a position within the glass envelope away from the at least one of the one or more openings;
- repositioning and/or expanding the first device component within the glass envelope after melt-joining.

By moving the first device component to a position within the glass envelope away from the openings prior to melt-joining, the device component is kept away from the heat needed to melt-joined the cap or caps. So the electronic component will not be affected and cannot get degraded.

The glass cap(s) may comprise at least one electrical terminal, wherein the electric component is connected to the at least one electrical terminal. The electrical terminal may be fed through the glass cap from a first side to an opposing side, so that an electrical connection can be established from the electrical component inside the envelope to a connection outside the envelope. The electric component may be connected to the electrical terminal by way of repositioning the first electronic component. Repositioning may be established using gravitational forces or magnetic forces. Alternatively, a rod may be inserted into one of the gaps to push the electronic component to its final position where it is connected to the electrical terminal.

In an embodiment the first device component comprises a light engine comprising one or more Light Emitting Diodes (LEDs). By inserting the LEDs into the glass envelope a so-called TLED (retrofit TL lamp comprising LEDs) may be produced with an envelope fully made of glass, which may be preferred as compared to plastic.

In an embodiment, the light engine comprises two elongated carriers, each of the elongated carriers comprising a connection unit arranged for connecting the respective elongated carrier to the other of the two elongated carriers. The elongated carriers are repositioned by means of gravitational and/or magnetic forces and connecting the two connection units are connected by means of gravitational and/or magnetic forces. The connections between the carriers could be electrical and/or mechanical connections. The carriers could already be electronically pre-wired using flexible electrical connections before they are actually connected in a mechanical way.

In an embodiment, the light engine is foldable wherein the light engine is inserted in a folded state through the one of the one or more openings before the glass cap is provided, and wherein the light engine is unfolded by means of gravitational and/or magnetic forces after the glass cap has been provided. Instead of a folded component, the component may be covered rolled or spiraled before inserting into the glass envelope.

In an embodiment, a housing comprising electrical components is inserted into the glass envelope. The housing may have a cross-section substantially equal to an inner cross section of the glass envelope. So if for example, the envelope is tubular having a circular cross section, the housing will also have a circular cross section. The repositioning of the housing within the glass envelope may be done by moving the housing within the envelope by means of applying a vacuum to a channel in the glass cap.

On or more of the glass caps may comprise a slot. In that case the glass envelope is closed with the glass gaps while still not being fully sealed. It is noted that in case of e.g. TLEDs, the glass envelope does not need to be fully sealed. A second device component may be inserted in the glass envelope through the slot thereby repositioning and/or expanding the first device component within the glass envelope. The second device component may be an elongated component such as a light engine having on or more LEDs.

In an embodiment, before inserting the first device component, the first device component is connected to a second elongated second device component, and the glass envelope is provided at a first opening with a first glass cap comprising a slot. The first and the second device component are inserted in the glass envelope through a further opening not yet provided with a glass cap towards the first glass cap, wherein the second device component is pushed through the slot of the first glass cap from the inside while keeping the first device component inside the envelope. Next, a second glass cap is melt-joined to the envelope at the further opening, and then the first device component is repositioned within the glass envelope by way of pushing the second device component back into the envelope through the slot. So before inserting the components into the envelope, they are already properly connected. The envelope may be a glass tube, wherein the first component is a tubular pod comprising electronic. The pod can be placed near the glass cap opposite from the further opening to be melt-joined. The pod can be pushed back by means of pushing the second elongated component, such as a light engine, back through the slot.

According to a further aspect, there is provided a lighting device manufactured by the method as described above.

According to yet a further aspect there is provided a luminaire comprising at least one lighting device as described above.

The invention proposes to use glass envelopes that contain one or more intentional engineered access holes through which electronic components or other components can be inserted into the envelope before joining the envelope with one or more other glass elements. In an embodiment so-called prior-joining insertion is used, e.g. in the glass envelope a so-called pod is inserted prior to closing of the glass envelope together with one or more glass elements, such that the pod can positioned at a cooler section of the glass envelope during sealing. The pod may contain the driver for the SSL device.

The post-joining insertion is enabled in bulbs and tubes in using glass end-caps or bulb stems having a slot, the engineered leak. The slot may comprise a small part of the circumference of the glass disc or stem up having an opening of up to 90% of it circumference, reducing its disc shape to that of a "bar". Thus after having joined the glass pieces together a rigid and strong glass envelopes remains having one or more access holes or slots allowing for the insertion of electronic components through the slots into the interior of the glass envelope. Characteristic for the bar and or the partial disc it that these parts contain at least one electric terminal that feeds from the outside of the envelope to the interior of the envelope, such that a galvanic potential can be applied at the outside of the envelope.

Components that can be inserted are for example (paper) reflectors, diffusers, LEDs, PCBs (printed circuit board) or a single assembly thereof either or not equipped with high-voltage electronic drivers and/or intelligent micro-electronic devices. Alternatively, the glass envelope slides over the electronic assembly at the position of the slot(s).

BRIEF DESCRIPTION OF THE DRAWINGS

These and other aspects of the invention will be apparent from and elucidated further with reference to the embodiments described by way of example in the following description and with reference to the accompanying drawings, in which.

The figures are purely diagrammatic and not drawn to scale. In the Figures, elements which correspond to elements already described may have the same reference numerals.

DETAILED DESCRIPTION OF EMBODIMENTS

Figure 1:
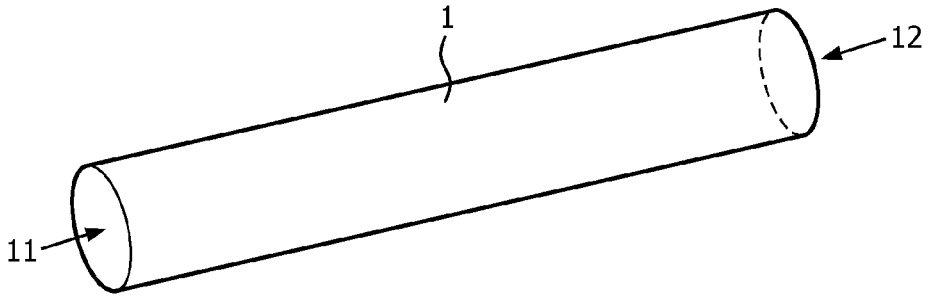
FIG. 1 is a perspective view of an example of a glass envelope, being a glass tube.
Figure 2:
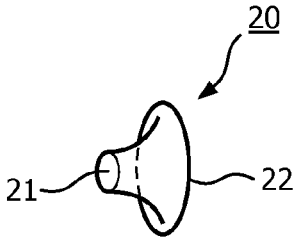
FIG. 2 shows a perspective view of an example of a glass cap.

In an embodiment a method of manufacturing a lighting device comprises providing a glass envelope having one or more openings. FIG. 1 is a perspective view of an example of a glass envelope, being a glass tube 1 having a first opening 11 and a second opening 12. In an embodiment, the openings 11, 12 are provided with respective caps made of glass, referred to as glass caps. FIG. 2 shows a perspective view of an example of a glass cap 20. The glass cap 20 is actually a channel having a glass wall which has a relatively small cross section at a first side 21 and a larger cross section 22 at an opposite side. The larger cross section is dimensioned so as to correspond to a cross section of the glass tube 1 of FIG. 1. The glass caps may be provided with at least one electrical terminal that feeds through the glass cap.

Figure 3A:
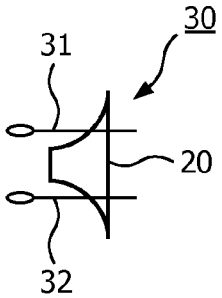
FIGS. 3A and 3B show two different embodiments of a glass cap.
Figure 3B:
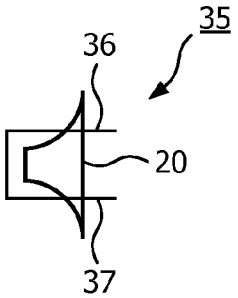

FIGS. 3A and 3B show two different embodiments of a glass cap. In FIG. 3A, a glass cap 30 comprises two electrical terminals 31, 32 (also referred to as electrical leads 31, 32) which are fed through the glass cap body 20, which resemble the embodiment of FIG. 2. FIG. 3B, a glass cap 35 comprises two electrical terminals 36, 37 which are fed through the glass cap body 20. The two electrical terminals 36, 37 are connected at a first side of the glass cap 20, so as to form a short circuit. This type of connection may be used for retrofit TLED tubes, which are compatible with a so-called electronic ballast. Which type of connection is needed for a specific application will depend on the region and on the wiring of a TL luminaire in that region. For Europe it can be a short circuit if the tube is retrofit. For retrofit tubes the short circuit may comprise a fuse or a fuse-resistor, to provide a means of overload protection. For only mains compatible TLED tubes, the ballast needs to be removed and the luminaire needs rewiring to feed the mains voltage at a single end of the tube. In that case a tube only needs pins at the outside of the tube as mechanical support, using a cap similar to FIG. 3B but without the short circuit at the inside.

In an embodiment, a first device component is inserted through one of the openings of the glass tube 1 before the glass caps are melt-joined to the glass tube 1. The first device component may be an electronic component or a non-electronic component. Examples of possible components to be inserted are: (paper) reflectors, diffusers, heat-sinks, LEDs, PCBs or a single assembly thereof either equipped with high voltage electronic drivers and/or intelligent micro-electronic devices.

Figure 4:
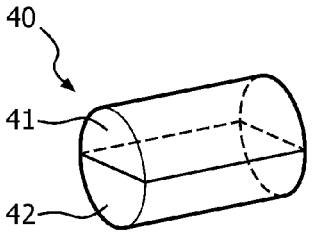
FIG. 4 shows an example of such a housing for holding a high voltage electronic driver.
Figure 5:
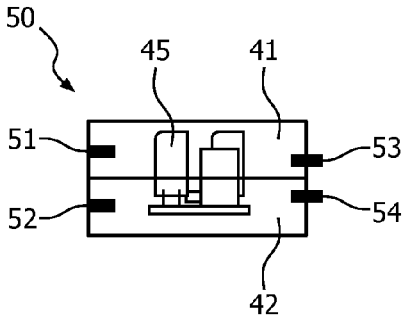
FIG. 5 schematically shows an electronic driver placed in the housing of FIG. 4.

In an embodiment, a high voltage electronic driver is arranged in a housing. FIG. 4 shows an example of such a housing 40. The housing 40 may be made out of plastic or any other suitable material, but preferably made of an electrical isolating material. In this embodiment, the housing 40 comprises two parts, see part 41 and part 42. FIG. 5 schematically shows an electronic driver 45 placed in the housing 40 of FIG. 4. The assembly shown in FIG. 5 is further referred to as pod 50. In this example, the pod 50 comprises electrical connections 51, 52 at a first side of the pod 50, further electrical connections 52, 54 at an opposite side of the pod 50. As can be seen form FIG. 5, the electrical connections 53, 54 extend away from the respective housing parts 41, 42.

Figure 6:
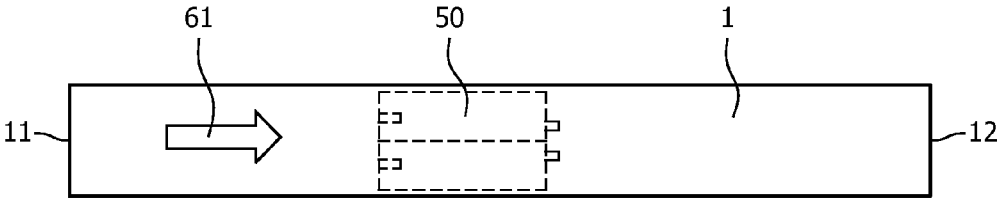
FIG. 6 schematically shows a further step of the method of manufacturing of lighting device.

FIG. 6 schematically shows a further step of the method of manufacturing of lighting device. The first device component, i.e. the pod 50, is positioned within the glass tube 1, see arrow 61. The device component 50 is positioned so as to be away from those openings that still need to be provided with a glass cap, also referred to as openings to be closed. In this example both openings 11, 12 are not yet provided with a glass cap, so the pod 50 is placed in the middle, or close to the middle, of the glass tube 1.

Figure 7:
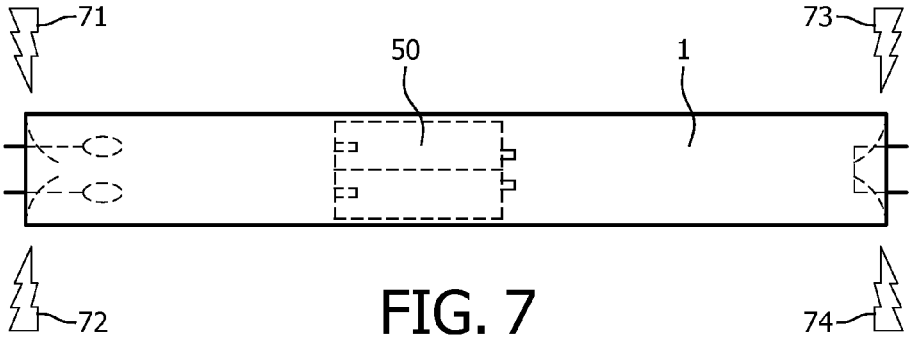
FIG. 7 schematically shows a further step of the method of manufacturing of lighting device, wherein glass caps are melt-joined onto each of the openings to be closed.

Next, the glass caps 30, 35 are melt-joined onto each of the openings to be closed. For that purpose the outer ends of the glass tube 1 and the glass caps 30, 35 are heated as is shown in FIG. 7. In FIG. 7, flames 71, 72, 73, 74 indicate that the glass is heated to a temperature at which the glass of the glass caps 30, 35 at least partially melt. Typical temperatures to be used lie in the range of 1000-1400° C. At such high temperatures, many electrical components, especially solid state components, will be effected in a negative way, and may get damaged or destroyed. By moving the pod 50 away from the outer ends of the glass tube 1, the pod 50 will not be heated too much and damage to the electronics inside the pod 50 is avoided.

After the glass caps 34, 35 are melt joined to the tubular glass tube 1, the glass tube 1 is closed, except for the small channels in the glass caps 34, 35. Depending on the application, the glass caps 34, 35 may be fully closed or one or more joined caps may contain a small mail-box or a slot as will be explained with reference to FIGS. 9A, 9B and 9C.

After melt joining the glass caps 34, 35 to the glass envelope 1, the first device component (i.e. the pod 50) is repositioned within the glass tube 1 so that the pod 50 is connected to the electrical terminals 31, 32 of the glass cap. Repositioning may be done in several ways.

A first option is to change the orientation of the glass tube 1 so as to slide the pod 50 towards one of the glass caps 34, 35. In this way gravitational forces are used to reposition the pod 50 within the glass tube 1. Gravitation can also be used to rotate the pod 50 within the glass tube 1.

Another option is to provide the pod 50 with one or more ferro-magnetic metal pads that can attracted by a magnetic field outside the glass tube 1. So by modulating the external electro-magnetic field, the pod 50 can be moved and oriented into a requested position.

Yet another option is to use a tubular shaped pod having such dimensions that its cross section is slightly less than an inner cross section of the glass tube 1. In this way, no or little air or gas can flow between the pod 50 and the glass tube 1. By applying a vacuum or an overpressure at one side of the pod 50, the pod 50 can be pushed through the glass tube 1 until it arrives at a requested position.

A further alternative of repositioning the first device component is to insert a second device component via the slot into the glass tube 1 after melt-joining the glass caps 34, 35, and to manipulate the position of the first device component with the second device component. Alternatively, a manipulation rod can be inserted into the closed tube through a pumping stem (see hollow tube 103 in FIG. 9A and FIG. 13) being part of the glass caps.

Figure 8:
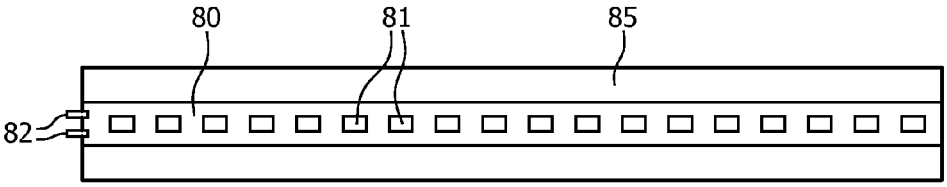
FIG. 8 shows a top view of an example of a light engine having a plurality of LEDs arranged in an array.

In an embodiment, a tubular shaped lighting device is manufactured comprising a light engine comprising a plurality of LEDs. FIG. 8 shows a top view of an example of a light engine 80 having a plurality of LEDs 81 arranged in an array. The light engine 80 comprises connections (not shown) and connection points 82 at one outer end. The light engine 80 may be a L2 light engine as will be known by the skilled reader. A paper reflector 85 is joined with the light engine 80 before both are inserted into the glass tube 1.

Figure 9A:
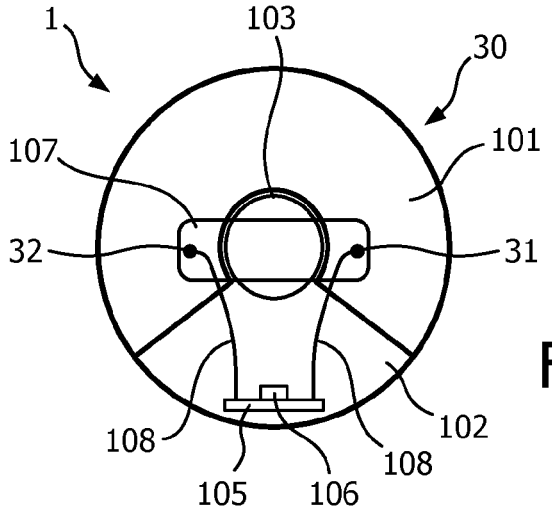
FIGS. 9A, 9B and 9C show top views of an outer end of the glass tube after the melt-joining of a glass cap to the glass tube.
Figure 9B:
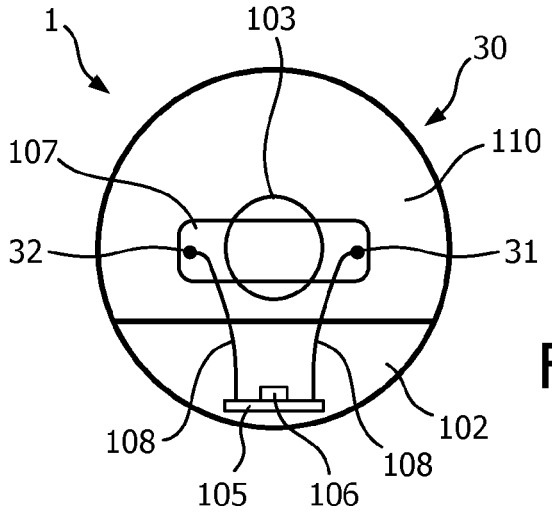
Figure 9C:
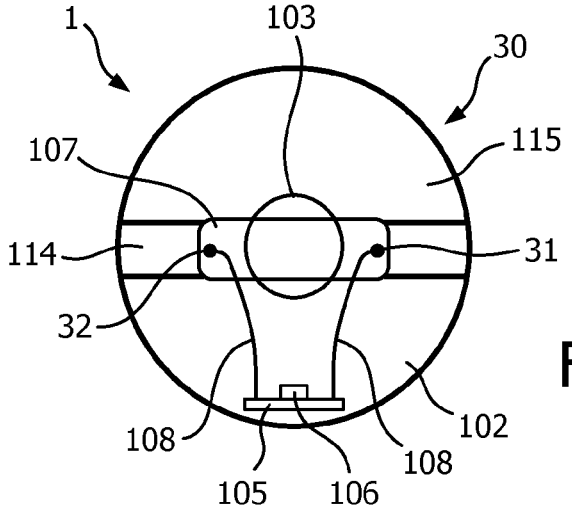

In an embodiment, at least one of the glass gaps 34, 35 comprises a slot which gives access to the interior of the glass tube after melt-joining the glass caps 34, 35 onto the glass tube 1. FIGS. 9A, 9B and 9C show top views of an outer end of the glass tube 1 after the melt-joining of a glass cap to the glass tube 1. In the example of FIG. 9A, the glass cap 30 is shown having a disc shape having a closed part 101 and an open part 102, also referred to as slot 102 or mail box 102. The glass cap 30 is connected to a hollow tube 103 (i.e. a pumping stem) at the center. Using a tube such as the tube 103, is known from the art. The tube 103 may be used to place the glass cap 30 onto the glass tube 1 for melt-joining. After melt-joining, the pumping stem 103 is disconnected from the glass cap 30, e.g. by forcing a break at the end of the pumping stem 103.

FIG. 9A also shows a light engine 105 with an array of LEDs 106 inserted into the glass tube 1 through the slot 102. The substantially rectangular shaped body 107 represents a glass body connected to the glass cap 30, and leading the electrical leads 31, 32 through the glass cap. The light engine 105 is connected to the electrical leads 31, 32 by way of two wires 108.

Together with inserting the light engine 105, a paper reflector 85 may also be inserted to set the desired beam-angle. Note that this optional paper reflector 85 was not shown in FIG. 9A for which the L2 was fixed to the glass by adhesive means.

FIG. 9B shows a further example of the glass cap having a closed part 110 and an open part 102, also referred to as slot 102. The glass cap 30 is connected to the hollow tube 103 at the center.

FIG. 9C shows yet a further example of the glass cap having a closed part 114 and two open parts 115 and 102, also referred to as slots 115, 102. The glass cap 30 is connected to a tube 103 at the center.

If there is no need for a reflector (wide beam-angle) than the slot can be small, see FIG. 9A. If a narrow beam-angle is required the reflector may span 180 degrees or more, thus the mail-box needs to be large, see FIG. 9C. Obviously, the glass cap 30 is stronger when there is more glass, less mail-box.

Figure 10:
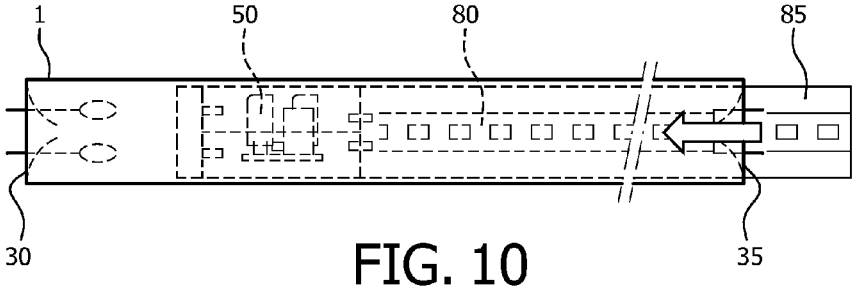
FIGS. 10, 11, 12 schematically show a side view of the glass tube in different stages of manipulating device components within the tube.

In an embodiment, the pod 50 is placed in the middle of the glass tube 1 before the glass caps 30, 35 are melt-joined to the glass tube 1. FIG. 10 schematically shows a side view of the glass tube 1 to explain the manufacturing step of subsequently inserting the light engine 80 together with the paper reflector 85 into the glass tube 1 through an opening in the glass cap 35, see right side of FIG. 10. In this example the glass engine 80 will push the pod 50 towards the glass cap 30, i.e. to the left in FIG. 10. The light engine 80 will push onto the pod contacts, and the thus joined parts now then move as one until the pod 50 connects to the electrical connection in the glass cap 30. Than the mail box is closed by a washer and an Al cap. The insertion of the light engine 80 and/or the paper reflector 85 may be done manually or it may be automated using a tool manipulating the device components so as to insert them into the glass tube 1.

Figure 11:
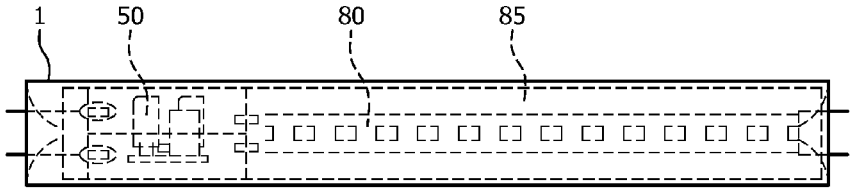

FIG. 11 shows a side view of the glass tube 1 in a situation wherein the light engine 80 has pushed the pod 50 to the outer left side of the glass tube 1 wherein the connections of the pod 50 make contact with the electrical terminals 31, 32 (see also FIG. 3A) of the glass cap 30. The light engine 80 and the paper reflector 85 are designed so as to completely fit into the glass tube 1.

Figure 12:
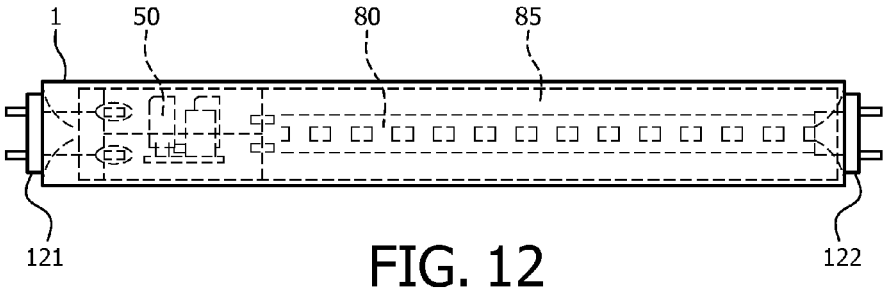

FIG. 12 shows a further step in which end-caps 121, 122, such as Aluminum end-caps, are cemented on the outer ends of the envelope 1. The end-caps 121,122 comprise connectors for connecting the lighting device into an armature or the like.

In an embodiment the light engine 105 is already soldered to the driver pod connections 53, 54 before insertion of the whole assembly (i.e. the pod with the light engine) into the glass tube 1. One glass cap having a mailbox is first melt-joined to the glass tube 1. Next, the assembly is inserted from a side not yet provided with a glass cap. The assembly is inserted so that the light engine 105 comes first followed by the pod 50. After insertion of the assembly, a part of the light engine 105 will stick out of the glass tube 1 through the mailbox. Next, the other end-cap is melt-joined to the glass tube 1 to close it. Then the pod 50 and light engine 105 are repositioned. The pod 50 may be pushed onto the mains pins at the opposing side 31, 32, the light engine 105 may contain mains feeding tracks toward the driver pod 50 and wires for providing mains are connected to the wires at the mail-box side. Another option is to shape the metal wires of the glass stem 107 in such a way that they acts as springs. Thus the metal wires can establish a mechanical contact between the light engine 105 and the glass-cap carrying the mains input wires.

Using the steps described above, a solid state lighting device, such as a TLED can be manufactured having an overall glass envelope. Due to the glass caps, the glass envelope is strong and may be manufactured similar to traditional (non-solid-state) lighting devices, such as fluorescent tubes.

As described above a manufacturing method is suggested to manufacture a lighting device having one or more device components that contain solid state technology, such as LEDs, integrated circuits, etcetera. Prior to joining a glass envelope with glass caps, the devices are inserted into the envelope. Such a method is very useful in glass tubes. In such tubes a so-called pod may be inserted prior to sealing of the glass based tube ends in that the pod can positioned at the cooler section(s) of the tube, for example in or near the center of the long glass tube when sealed both sides at the same time. Here the temperature stays relatively low because of the poor thermal conductivity of the glass.

Alternatively, first e.g. the left hand side tube end is closed, the pod is inserted and moved to the closed side, after which the right-hand side tube end is closed, wherein even after the joining of the glass, the pod is still able to slide within the tube. In this way, the electric contact into and out of the pod may be aligned towards for example the main wires at the glass end-cap and/or an insert-able as for example an L2/reflector assembly.

Figure 13:
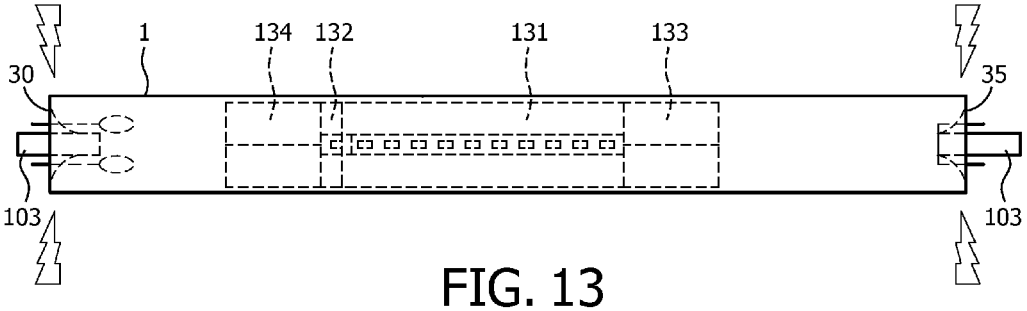
FIGS. 13 and 14 show side views of the glass tune of a further embodiment having a light engine comprising two elongated carriers.

A further embodiment is discussed with reference to FIGS. 13 and 14. In this embodiment the light engine comprises two elongated carriers 131, 132 which comprise a connection unit (not shown in FIGS. 13 and 14) arranged for connecting the respective elongated carrier 131, 132 to the other of the two elongated carriers 132, 131. In the example of FIG. 13, each of the carriers 131,132 is connected to an associated pod, see pods 133, 134 and inserted into the glass tube 1 before melt-joining the glass caps 30, 35.

Figure 14:
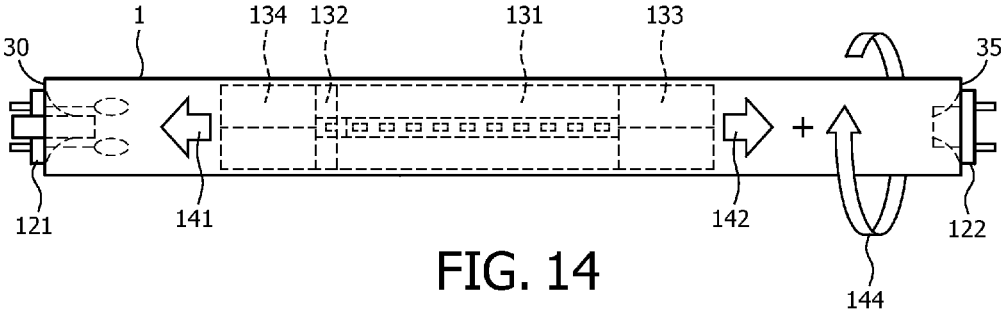

Once the glass envelope is closed, see FIG. 14, aluminum end-caps 121, 122 are arranged at the outer ends of the lighting device. Next, the elongated carriers are repositioned by means of magnetic forces, and the two connection units are interconnected by means of magnetic forces which will be discussed in more detail below. Instead of magnetic forces, gravitational forces could be used, or air pressure could be used in case the carriers are already connected to respective pods. In FIG. 14 the two arrows 141, 142 indicate that the pod 134 and the connected light engine carrier 132 is moved to the left towards glass cap 30, while the pod 133 and the connected light engine carrier 131 are moved to the right towards glass cap 35. An arrow 144 indicates that the device components 131, 132, 133, 134 can also be rotated within the glass tube 1 by means of e.g. magnetic forces.

Figure 15:
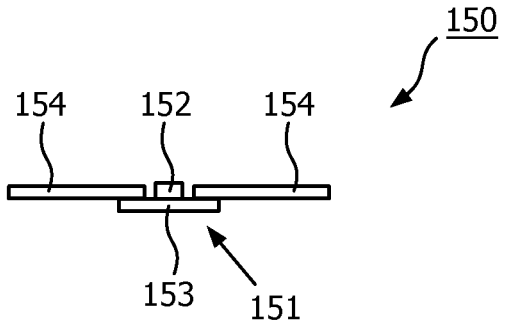
FIG. 15 shows a cross section of an embodiment of an L2/reflector assembly.
Figure 16:
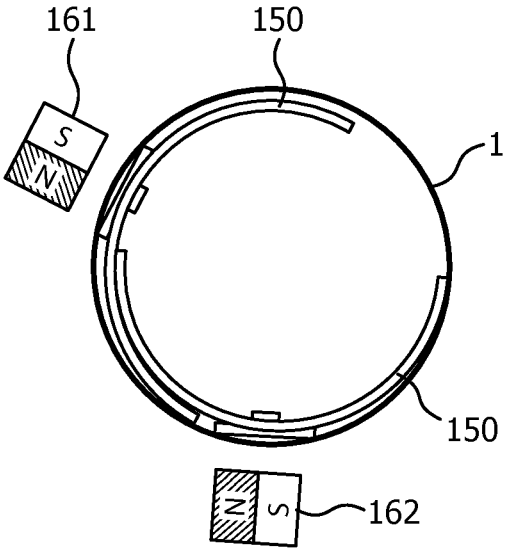
FIG. 16 shows a cross section of the glass tube with two L2/reflector assemblies inserted.

FIG. 15 shows a cross section of an embodiment of an L2/reflector assembly 150. The assembly 150 comprises an L2 engine 151 with LEDs 152 and with ferro-magnetic (e.g. iron or a (permanent magnet)) strip 153 at a backside. The strip 153 may be contoured so as to more effectively transfer the heat of the large lumen packages towards the glass tube. The assembly 150 further comprises a reflector 154 having a number of openings for receiving the LEDs 152. FIG. 16 shows a cross section of the glass tube 1 with two L2/reflector assemblies inserted. The reflectors of the assemblies are flexible and will follow an inner wall of the glass tube 1 after insertion therein. After closing of the glass tube 1 by adding the glass caps (not shown), two magnets 161, 162 are placed close to the glass tube 1 so as to attract the respective iron strips of the two L2/reflector assemblies 150. As will be clear to the skilled reader, the magnets can be used to reposition the assemblies 150 within the glass tube 1. Manipulation can be done in both a radial and an axial direction.

Figure 17A:
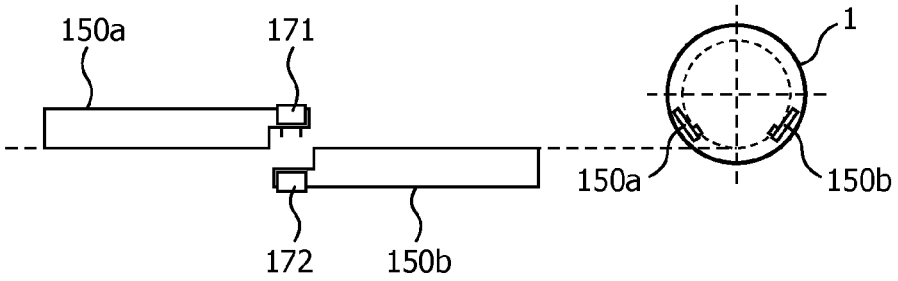
FIGS. 17A, B, C each schematically show a cross section of the embodiment of FIG. 16 and a top view through the glass tube of the L2/reflector assembly with the tube.

FIG. 17A shows a cross section of the embodiment of FIG. 16, see right side, and a top view through the glass tube 1 of the L2/reflector assembly with the tube 1, see left side. Each of the assemblies 150*a*, 150*b* comprises a connector, see connector 171, 172.

Figure 17B:
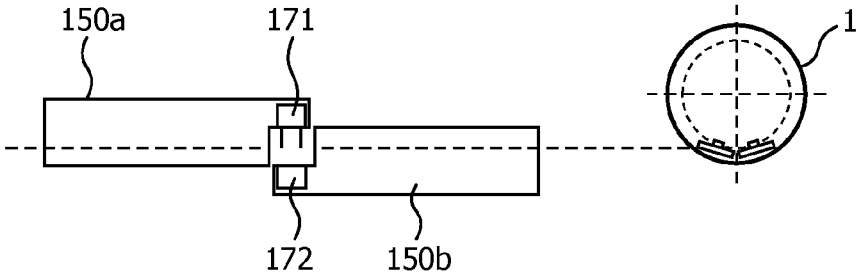

FIG. 17B shows a cross section of the embodiment of FIG. 16, see right side, and a top view through the glass tube 1 of the L2/reflector assembly with the tube 1, see left side. FIG. 17B shows a situation wherein the two assemblies almost mate.

Figure 17C:
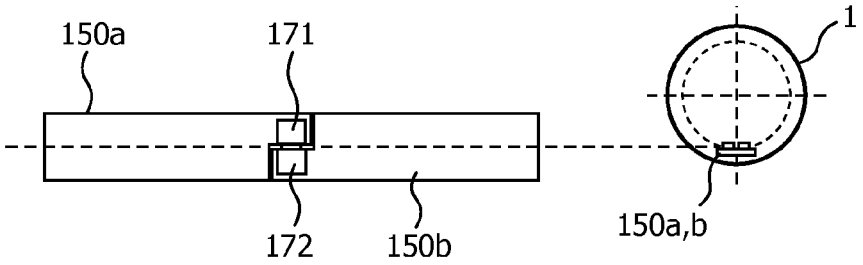

FIG. 17C shows a cross section of the embodiment of FIG. 16, see right side, and a top view through the glass tube 1 of the L2/reflector assembly with the tube 1, see left side. FIG. 17C shows a situation wherein the two assemblies are connected by way of connecting the respective connectors 171, 172. As is mentioned above the relative movement of the two assemblies 150*a*, 150*b* may be achieved by manipulating the assemblies using magnets, or alternatively gravitational forces can be used.

There are several solutions to solve the problem of the connection between the two sub-assemblies 150*a*, 150*b* and/or to a driver to mains. Below four of these solutions are discussed.

1) Sub-assemblies already have the electrical and mechanical connections towards each other in place prior to (insertion and) expansion—e.g. sliding ladder coming with flexible electric cables;

2) Sub-assemblies only having the electrical connections established towards each other prior to (insertion and) expansion—flexible cable or sliding electric contact within an electric bushing or (along a) track.

3) Sub-assemblies having only the mechanical connections established towards each other prior to (insertion and) expansion—sliding ladder or strip mechanical guiding the expansion. On full expansion the electric connection clicks, snaps, presses, clips or clamps together;

4) Sub-assemblies having no electrical and no mechanical connection established prior to (insertion and) expansion—both mechanical and electric contacts/connections are being established on full expansion.

Instead of repositioning the device component(s), such as the pod 50, within the glass envelope (i.e. glass tube 1), the device component(s) may be expanded. The device component(s) may be a foldable light engine, or foldable light reflector or light diffuser, which may be unfolded after the glass envelope has already been closed. Alternatively, the device component may be covered rolled or spiraled before inserting into the glass envelope.

Figure 18:
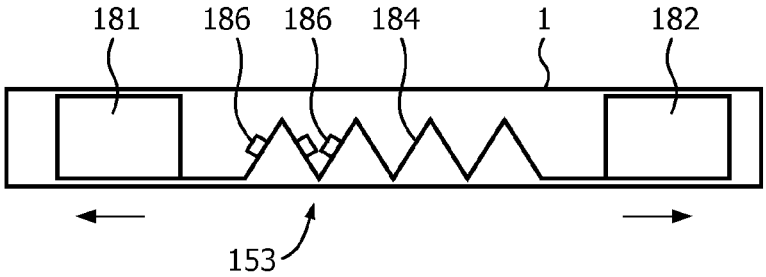
FIG. 18 shows a side view of the glass tube with two pods inserted which are both connected to one light engine which is foldable.

FIG. 18 shows an embodiment of a the light engine which is foldable and wherein the light engine is inserted in a folded state through the one of the one or more openings before the glass cap is provided, and wherein the light engine is unfolded by means of gravitational and/or magnetic forces after the glass cap(s) has/have been provided. FIG. 18 shows a side view of the glass tube 1 with two pods 181, 182 inserted which are both connected to one light engine 184 which is foldable. The light engine may comprise lamellas which are provided with LEDs, see LEDs 186 in FIG. 18. The pod 181, 182 can be repositioned by using magnets or vacuum applied at the outer ends of the glass tube 1. By repositioning the pod 181, 182 the folded light engine 184 is unfolded. It should be clear that instead of a light engine, other device components could be folded and unfolded, such as a reflector, radio antenna, diffuser, etc. etc.

Figure 19:
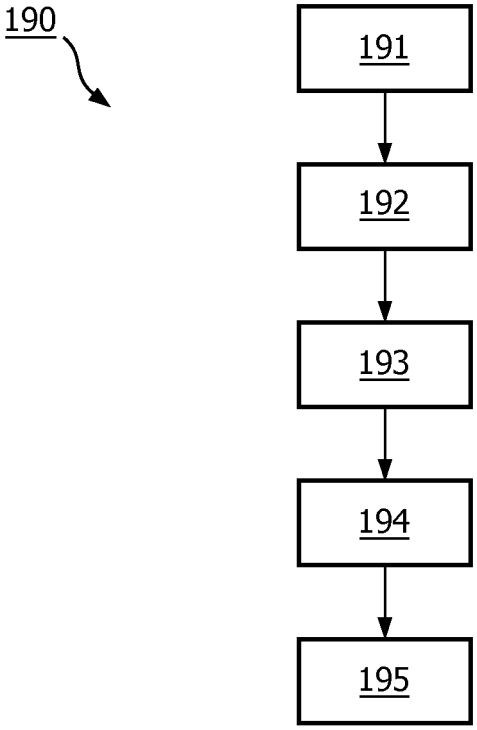
FIG. 19 is a flow chart of a method of manufacturing a lighting device according to an embodiment if the invention.

FIG. 19 is a flow chart of a method 190 of manufacturing a lighting device according to an embodiment if the invention. The method 190 comprises: providing a glass envelope having one or more openings, see step 191. Step 190 is followed by inserting a first device component through one of the one or more openings, see step 192. Step 192 is followed by moving the first device component to a position within the glass envelope away from those of the one or more openings that are to be provided with a glass cap, also referred to as openings to be closed, see step 193. Step 193 is followed by melt-joining the glass cap(s) onto each of the openings to be closed, see step 194. Step 194 is followed by repositioning and/or expanding the first device component within the glass envelope, see step 195.

It is noted that instead of using a tubular envelope, other types of glass envelopes could be used to manufacture for example having a triangular shaped cross section. Alternatively, the envelope may be bulb shaped to manufacture solid state light bulbs. In that case the envelope may be bulb shaped having one opening which is closed after a first device component has been inserted. To avoid damage due to high temperatures, the first device component could be placed away from the opening to be closed. After melt-joining of the glass bulb with a glass cap, such as a glass stem, the first device component can be repositioned to a place/position wherein for example connections can be made with wires fed through the stem.

Figure 20:
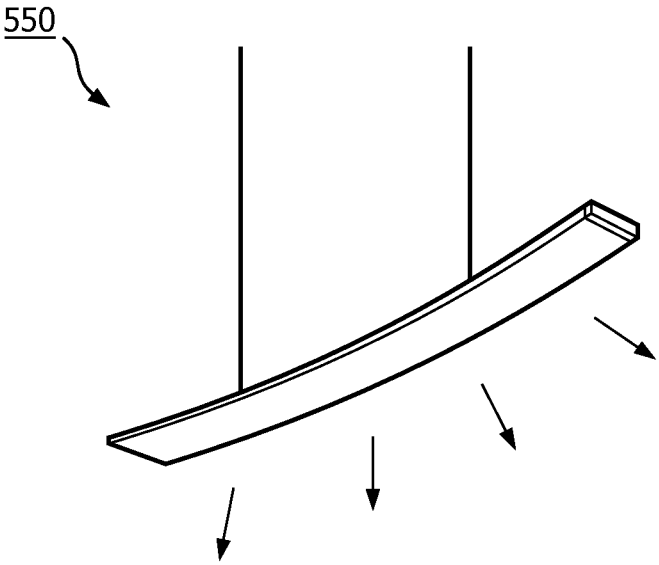
FIG. 20 schematically shows an embodiment of a luminaire.

FIG. 20 shows an embodiment of a luminaire 550 that comprises one or more lighting devices according to the invention (not shown in FIG. 20).

It is noted, that in this document the word 'comprising' does not exclude the presence of other elements or steps than those listed and the word 'a' or 'an' preceding an element does not exclude the presence of a plurality of such elements, that any reference signs do not limit the scope of the claims. Further, the invention is not limited to the embodiments, and the invention lies in each and every novel feature or combination of features described above or recited in mutually different dependent claims.

The invention claimed is:

1. A method of manufacturing a lighting device, the method comprising:

providing a glass envelope having one or more openings;

inserting a first device component into the glass envelope through one of the one or more openings;

providing at least one of the one or more openings with a glass cap by way of melt-joining, wherein prior to melt-joining the first device component is moved to a position within the glass envelope away from the at least one of the one or more openings;

repositioning and/or expanding the first device component within the glass envelope after melt-joining.

2. The method of manufacturing a lighting device according to claim 1, wherein the first device component is an electric component and wherein the glass cap comprises at least one electrical terminal, the method further comprising:

connecting the electric component to the at least one electrical terminal.

3. The method of manufacturing a lighting device according to claim 2, wherein the at least one electrical terminal is fed through the glass cap from a first side to an opposing second side, wherein the electric component is connected to the at least one electrical terminal by way of repositioning the first electronic component.

4. The method of manufacturing a lighting device according to claim 1, wherein the first device component comprises a light engine comprising one or more Light Emitting Diodes (LEDs).

5. The method of manufacturing a lighting device according to claim 4, wherein the light engine comprises two elongated carriers, each of the elongated carriers comprising a connection unit arranged for connecting the respective elongated carrier to the other of the two elongated carriers, the method comprising:

repositioning the elongated carriers by means of gravitational and/or magnetic forces;

connecting the two connection units by means of gravitational and/or magnetic forces.

6. The method of manufacturing a lighting device according to claim 4, wherein the light engine is foldable and wherein the light engine is inserted in a folded state through the one of the one or more openings before the glass cap is provided, and wherein the light engine is unfolded by means of gravitational and/or magnetic forces after the glass cap has been provided.

7. The method of manufacturing a lighting device according to claim 1, wherein the glass envelope is tubular.

8. The method of manufacturing a lighting device according to claim 1, wherein the first device component comprises a housing comprising driver circuitry for driving further device components.

9. The method of manufacturing a lighting device according to claim 8, wherein the housing has a cross-section substantially equal to an inner cross section of the glass envelope, wherein the repositioning the first device component within the glass envelope comprises the moving of the housing within the envelope by means of applying a vacuum to a channel in the glass cap.

10. The method of manufacturing a lighting device according to claim 1, wherein the glass cap comprises a slot, the method comprising:

inserting a second device component in the glass envelope through the slot thereby repositioning and/or expanding the first device component within the glass envelope.

11. The method of manufacturing a lighting device according to claim 1, wherein before inserting the first device component, the first device component is connected to a second elongated second device component, and the glass envelope is provided at a first opening with a first glass cap comprising a slot, the method further comprising:

inserting the first and the second device component in the glass envelope through a further opening not yet provided with a glass cap towards the first glass cap, wherein the second device component is pushed through the slot of the first glass cap from the inside while keeping the first device component inside the envelope;

melt-joining a second glass cap to the envelope at the further opening, and then repositioning the first device component within the glass envelope by way of pushing the second device component back into the envelope through the slot.

12. A lighting device manufactured by the method according to claim 1.

13. A lamp comprising an armature and at least one lighting device according to claim 12.

* * * * *